United States Patent [19]

Hilal

[11] Patent Number: 4,944,212

[45] Date of Patent: Jul. 31, 1990

[54] MAGNETIC ADVANCED HYBRID RAIL GUN

[75] Inventor: Mohamed A. Hilal, Madison, Wis.

[73] Assignee: General Dynamics Corporation, Convair Division, San Diego, Calif.

[21] Appl. No.: 334,308

[22] Filed: Apr. 6, 1989

[51] Int. Cl.[5] ..... F41F 1/02

[52] U.S. Cl. ..... 89/8; 124/3; 310/14

[58] Field of Search ..... 89/8; 124/3; 310/14

[56] References Cited

U.S. PATENT DOCUMENTS

| | | | |
|---|---|---|---|
| 3,126,789 | 3/1964 | Meyer | 89/8 |
| 4,796,511 | 1/1989 | Eyssa | 89/8 |
| 4,817,494 | 4/1989 | Cowan | 89/8 |
| 4,846,911 | 7/1989 | Tackett et al. | 89/8 |

OTHER PUBLICATIONS

Peterson et al., "Design and Testing of High-Pressure Railguns and Projectiles", IEEE Transactions on Magnetics, vol. MAG-20, No. 2, Mar. 1984, pp. 252-255.

*Primary Examiner*—Stephen C. Bentley

*Attorney, Agent, or Firm*—John R. Duncan; Frank D. Gilliam

[57] ABSTRACT

A rail gun utilizing a combination of chemical energy for propelling a piston and a projectile. The piston movement creates electromagnetic energy in rails which further increases the velocity of the projectile as it leaves the gun barrel. In operation, propellants are introduced into the gun and ignited. High pressure gas produced from the combustion accelerates the piston and the projectile along the rails. An external field normal to the piston is applied from a dipole magnet wound around the gun bore. The piston movement induces emf thus charging the rails which act as an inductor. The current flowing in the rails further increases the velocity of the projectile along the barrel to its final exit velocity.

8 Claims, 1 Drawing Sheet

MAGNETIC ADVANCED HYBRID RAIL GUN

BACKGROUND OF THE INVENTION

The invention is directed to rail guns and more particularly to rail guns that use chemical energy and produce electromagnetic force to launch a projectile from a gun barrel.

Electromagnetic launchers (ELM) and electromagnetic gun (EMG) are well known in the prior art.

In a co-pending patent application of which I am a coinventor with George Lasker having Ser. No. 07/192,980 and was filed on May 12, 1988, now abandoned in favor of 07/403077, is directed to a synchronous inductive magnetic gun. This application discusses the background of magnetic gun development.

All of the known prior art is directed either to chemical energy guns which have been in existence since gun power was discovered and electromagnetic energy guns that have just recently came into importance due to the recernt need of high velocity projectiles.

None of the prior art has developed the use of a combination of chemical and electromagnetic energies to propel a projectile or to develop any such energy combination for a useful purpose.

This invention is directed to taking advantage of chemical energy to produce electromagnetic energy which is utilized to increased the expected velocity of a projectile exiting from a gun barrel.

There has been no combination of these energies to propel a projectile until the emergence of this invention.

SUMMARY OF THE INVENTION

Conventional guns use chemical energy to accelerate projectiles to their final velocity. Projectile velocity is limited to approximately 1 kilometer per second (km/s) due to the speed of sound constraint. Rail guns which utilize electromagnetic energy can achieve higher velocities, but they require the development of a high power source for there operation. This power source is comprised of a prime highcurrent source, a switch and inductor. These components are heavy and significant technological barriers must be overcome before light weight rail guns can become operational. The gun concept of the present invention eliminates the need for a high pulse power source and uses chemical energy to accelerate the projectile to high velocity the action of which propels a projectile from a gun barrel. The limitation of sound velocity is eliminated by the configuration of the gun.

In operation of the present invention, propellants are introduced into a gun barrel of a gun and are ignited; high pressure gas produced by the combustion accelerates the piston and projectile within the barrel; an external magnetic field positioned normal to the piston is supplied using a dipole magnet wound around the bore of the barrel; the piston motion induces electromotive force (emf) into rails guiding the piston and projectile positioned within the barrel which act like an inductor; current flowing in the rails accelerates the projectile to its final barrel exit velocity.

The dipole current slightly increases following firing and does not need to be recharged. Also the dipole is a lowcurrent electromagnet which can easily be charged with batteries or any similar portable power supply. The power supply is needed during operation to sustain the current at its operation level to compensate for joule losses in the windings.

An object of this invention is to provide a rail gun of high efficiency which utilizes energy from both a chemical reaction to induce electromagnetic forces to propel the projectile.

Another object of this invention is to produce a light weight mobile rail gun with high projectile velocities.

It is another object of this invention to provide a rail gun using a low current dipole magnetic which can be easily recharged with a battery power supply.

Yet another object of this invention is to provide a rail gun in which the projectile is launched by emf induced in the rails of a rail gun by the action of chemical energy.

Further objects and advantages of this invention, together with the organization and manner of operation thereof may be best understood by reference to the following description of the preferred embodiment of the invention when taken in conjunction with the accompanying drawings, in which like reference numerals designate like parts or elements throughout.

BRIEF DESCRIPTION OF THE DRAWING FIGURES

DETAILED DESCRIPTION OF THE PREFERRED EMBODIMENT OF THE INVENTION

Figure 1:
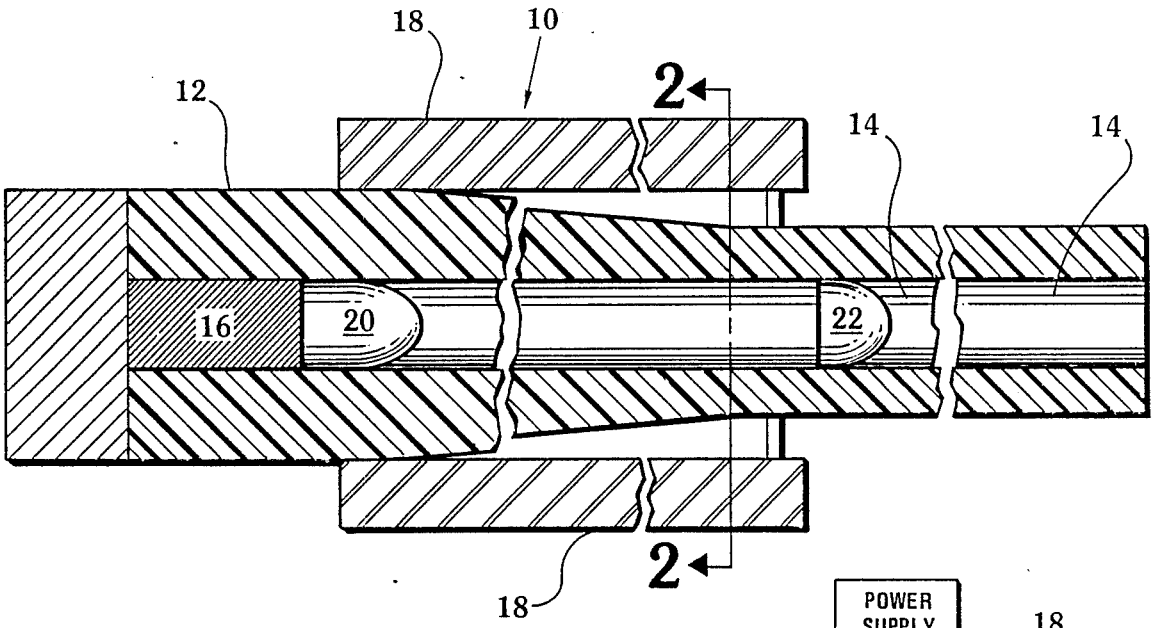
FIG. 1 is a schematic cutaway sectional showing of the rail gun of the invention.
Figure 2:
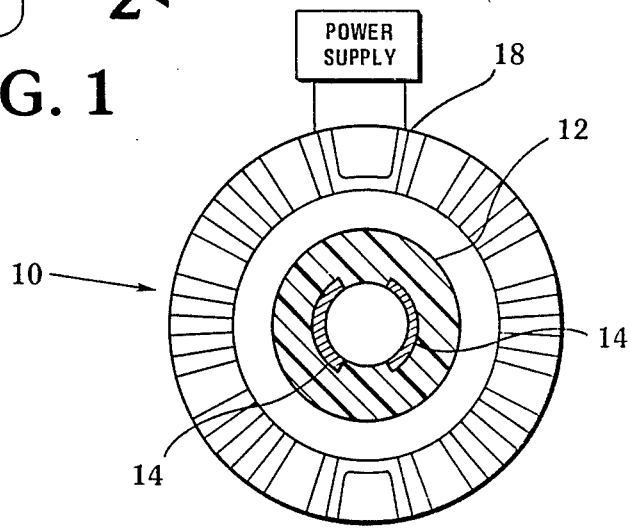
FIG. 2 is an end cutaway showing of FIG. 1 taken along line 2—2.
Figure 3:
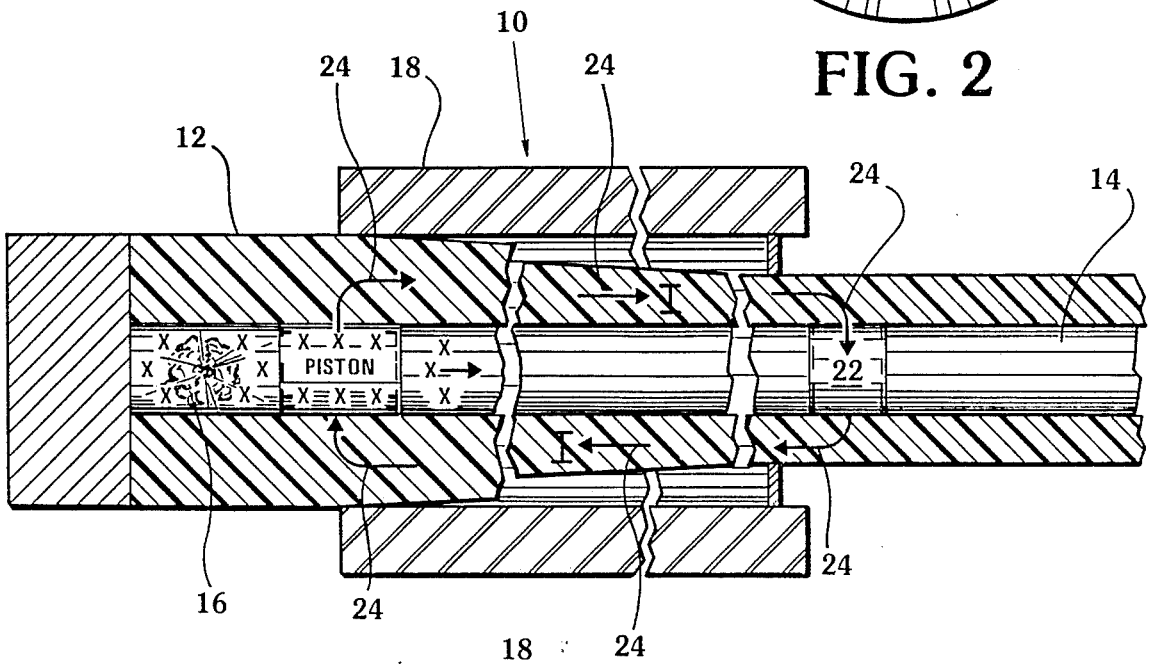
FIG. 3 is a schematic cutaway sectional showing of the operation of the rail gun of the invention.

Referring specifically to drawing FIGS. 1 and 2, which depicts the advanced rail gun 10 of the invention. The gun comprises a barrel 12 constructed of a non-conductive and non-magnetic material such as, KEVLAR plastic or EPOXY resin or the like suitable for practicing the invention. A pair of conductive rails 14 are spacedly positioned in a juxtaposed relationship along the inside of the gun barrel and are spaced from the upstream end of the barrel adjacent to the chemical ignition chamber 16. Positioned along the outside of the barrel intermediate the ends thereof is a dipole magnetic winding 18. The dipole magnet winding 18 is constructed from copper beryllium or similar low current conductive material and will include water cooling or the like, not shown. A piston 20 which is guided by the rails 14 is shown in its normal use position. A projectile 22 is shown in position for launching.

A typical rail gun of the type described would have a bore diameter of from 125 to 150 millimeters with an overall length of from 15 to 18 meters. The initial gas pressure from the igniting of explosives or the like to furnish the chemical energy would be from 45,000 to 70,000 pounds per square inch. The mass of the piston would be from 10 to 20 kilograms and would be constructed of metal or of other materials and clad or enclosed in a metal jacket. The maximum velocity of the piston with the initial gas pressure aforementioned would be between 1 and 1.3 kilometers per second. The mass of the projectile would be approximately 1 kilogram and would be constructed the same as the piston. The projectile exit velocity would be from 3.5 to 6 kilometers per second. The dipole magnetic field should develop from 5 to 8 Tesla.

The rails are constructed of beryllium copper or the like, the gun barrel is construed of a mon-conductive and non-magnetic material as aforementioned.

In operation, suitable chemical propellants are introduced in the upstream portion of the gun barrel upstream of the piston and are ignited; high pressure gas produced due to the combustion of the propellent accelerates the piston toward the projectile and accelerates the projectile; an external field normal to the piston is created by powering the winding wound around the gun barrel; the movement of the piston in the barrel induces an emf into the rails thus charging the rails which act as an inductor; the current flowing in the rails act on the projectile accelerating it to its final barrel exit velocity.

It should be understood that fast firing is possible since no pulsed energy is required as is with a conventional electromagnetic rail gun.

The foregoing description of the preferred embodiments of the invention have been presented for purposes of illustration and description. It is not intended to be exhaustive or to limit the invention to the precise form disclosed, and obviously many modifications and variations are possible in light of the above teachings. The embodiments was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An advanced concept rail gun comprising;

a non-conductive and non-magnetic rail gun barrel having a bore and an upstream and downstream end;

said barrel having a field winding wrapped around the outside thereof intermediate the ends thereof;

a low power source for charging said field winding;

a chemical reaction chamber in the upstream end of said barrel;

a pair of juxtaposed electrical conducting normally non-powered rails within said barrel extending from said chemical reaction chamber to the downstream thereof;

a piston guided within said bore during downstream movement by said rails normal to a field created by said field winding;

a projectile positioned in said bore downstream of said piston and guided by said rails whereby when said chemical reaction occurs in said reaction chamber said piston and said projectile are caused to translate within the bore at high speed in a downstream direction which causes emf from said field windings to be induced in said rails which further increases the velocity of said projectile as it exits the bore.

2. The invention as defined in claim 1 wherein said rails are constructed of beryllium.

3. The invention as defined in claim 1 wherein said piston has at least a metal outer surface.

4. The invention as defined in claim 1 wherein said projectile has at least a metal outer surface.

5. The invention as defined in claim 1 wherein said chemical reaction is an explosion.

6. The invention as defined in claim 1 wherein said barrel is constructed of KEVLAR plastic.

7. The invention as defined in claim 1 wherein said barrel is constructed of EPOXY resin.

8. The invention as defined in claim 1 wherein said low power supply is a battery.

* * * * *